United States Patent [19]

Müller et al.

[11] 4,433,662

[45] Feb. 28, 1984

[54] FUEL SUPPLY SYSTEM

[75] Inventors: Hans-Jürgen Müller, Gelsenkirchen; Karl Schmidt, Neuss; Asoke Chattopadhayay; Rolf P. Heidemanns, both of Neuss; Georg Habel, Brüggen; Ortwin Wittman, Kaarst, all of Fed. Rep. of Germany

[73] Assignee: Pierburg GmbH & Co., KG., Neuss, Fed. Rep. of Germany

[21] Appl. No.: 405,232

[22] Filed: Aug. 4, 1982

[30] Foreign Application Priority Data

Aug. 5, 1981 [DE] Fed. Rep. of Germany ..... 3130911

[51] Int. Cl.[3] ..... F02M 7/12

[52] U.S. Cl. ..... 123/438; 261/26; 261/39 R; 261/34 B; 261/DIG. 74; 123/432

[58] Field of Search ..... 123/308, 432, 437,438; 261/26, 34 B, 39 R, DIG. 74

[56] References Cited

U.S. PATENT DOCUMENTS

| | | | |
|---|---|---|---|
| 4,088,102 | 5/1978 | Kato | 261/34 B |
| 4,271,801 | 6/1981 | Yamakawa et al. | 123/308 |
| 4,303,048 | 12/1981 | Nishio | 123/438 |
| 4,361,123 | 11/1982 | Hori et al. | 123/432 |

*Primary Examiner*—William A. Cuchlinski, Jr.

*Attorney, Agent, or Firm*—Toren, McGeady and Stanger

[57] ABSTRACT a fuel system for mixture-compressing internal combustion engines controls the pressure differential of the extraction air required for proportioning the fuel. The system includes a fuel proportioning device and a vane pump for generating a carrier air stream for transporting the fuel into the suction tube of the internal combustion engine. A control valve constructed as a differential pressure valve influences the air pressure at the fuel outlet area and consequently the differential pressure for fuel proportioning. The throttle point is located in the carrier air channel upstream from the fuel proportioning area. A change in differential pressure adapts the mixture composition for various operating conditions. The signal level of the differential pressure is determined by the pressure decrease at the air quantity measuring valve formed as a pivotal flap and reaches the air channel where it is superimposed by the negative pressure, generated by the vane pump, and can be stabilized by the differential pressure valve and can be varied in dependence on motor operating parameters. To generate adequately high signal levels in the higher load range, the carrier air channels open into a Venturi arranged upstream from the main throttle valve. During different operating phases of the engine, various devices make it possible to maintain an adequately high signal value of the differential pressure.

11 Claims, 1 Drawing Figure

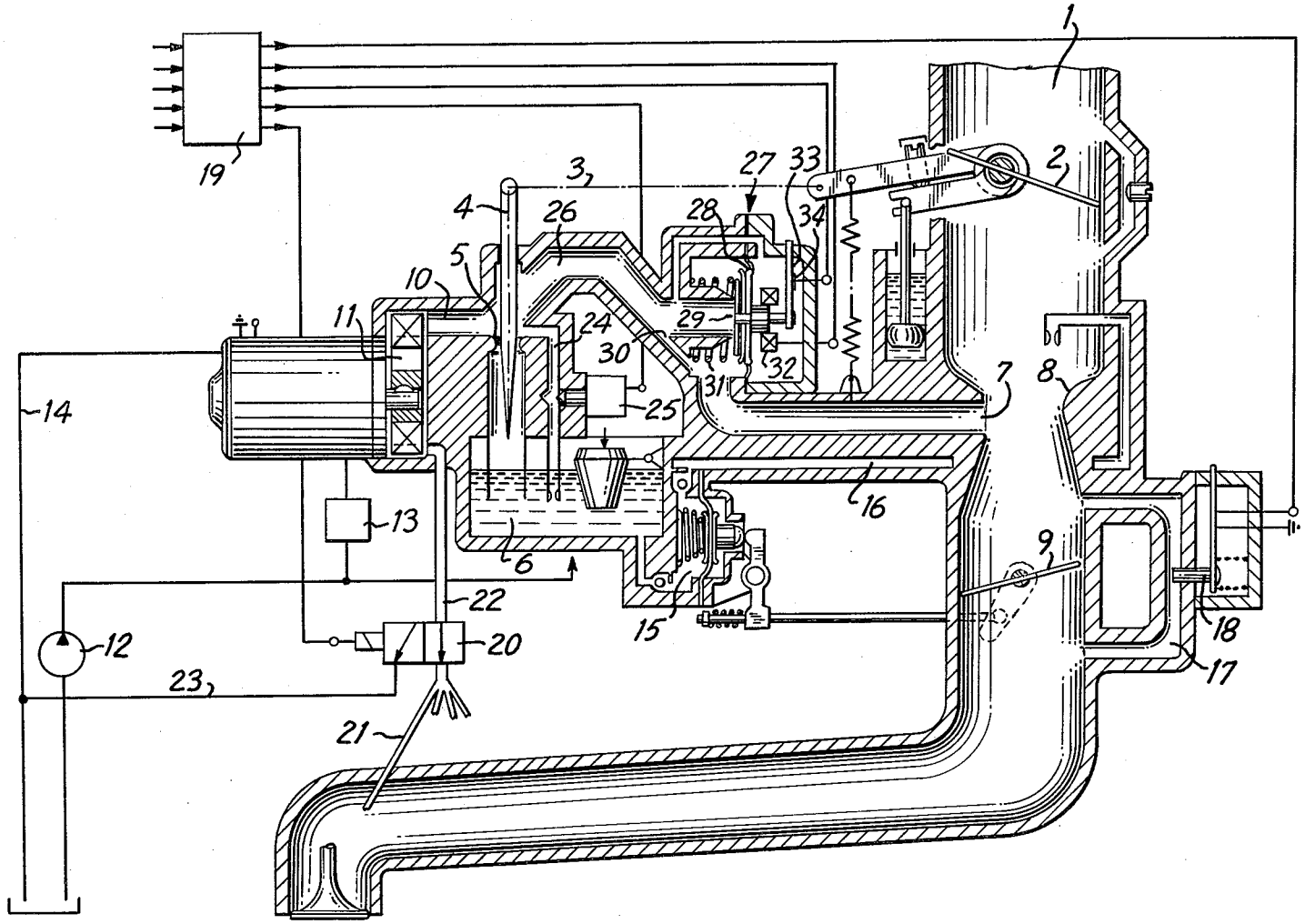
1
2
3
4
5
6
7
8
9
10
11
12
13
14
15
16
17
18
19
20
21
22
23
24
25
26
27
28
29
30
31
32
33
34

FUEL SUPPLY SYSTEM

The invention relates to a fuel supply system for mixture-compressing internal combustion engines, with a carrier air channel which is arranged in addition to a main air channel, having a throttle valve, and branches off from the main air channel between an air quantity measuring valve and the throttle valve. The fuel metering nozzle discharges into the carrier air channel. A proportioning valve is provided at the fuel metering nozzle which valve is adjustable in dependence on an air quantity measuring valve which is arranged in the main air channel upstream from the throttle valve. There is a pump, associated with the fuel metering nozzle, with distributor channels which originate from the carrier air channel downstream from the pump and lead to the associated suction nozzles before the inlet valves. There is a differential pressure valve which controls the carrier air stream, is arranged before the fuel metering nozzle, is adjustable in dependence on the operating parameters, and whose effective surface is acted upon on the one hand by a variable force and the air pressure in the carrier air channel at the fuel outlet area and on the other hand by the air pressure in the carrier air channel before the flow opening of the differential pressure valve.

Such a fuel supply system is described in the older patent application P 30 03 386.4-13. It is the task of the present invention to improve this system further, to make it structurally simpler and more economical, and particularly to make available the proportioning differential pressure at an always adequate signal level.

This task is solved in a fuel supply system of the type described above in that the carrier air channel discharges into a Venturi which is arranged downstream of the throttle valve in the air channel. Advantageous embodiments for stabilization of this signal and for maintenance of an adequate signal level at special operating phases of the internal combustion engine are given in the additional claims.

It is considered to be a special advantage of the solution according to the invention that the air measuring valve may be constructed as a simple flap and a force amplifier is not required. This is possible in connection with the mechanical coupling of the air quantity measuring valve with the proportioning needle in that the carrier air channel originates from a Venturi, arranged upstream from the throttle valve, whereby it is possible that proportioning of the fuel amount in dependence on the position of the air quantity measuring valve and consequently the relative position of the proportioning needle in the cross-section of the fuel nozzle which is variable by the needle stroke essentially is only dependent over an operating range of approximately $\frac{2}{3}$ of the capacity. Beyond this range of capacity, if the load is changed further, the change of the differential pressure which is responsible for fuel metering results essentially from the change of the Venturi signal. Also in this operating range, the effect of the differential pressure valve is superimposed to the signal formation for fine adjustment. In all operating ranges, the action of the pump is superimposed on the signal formation, and possible pressure fluctuations of the pump are balanced out by the function of the differential pressure valve.

An exemplified embodiment of the invention is schematically shown in the drawing and is further described below wherein the advantages of the embodiments given in the subclaims can be concluded from the specification in connection with the task definition and the concept of the total solution statement.

The system comprises an air quantity measuring valve 2 which is arranged in a main air channel 1 and connected by means of a linkage 3 with a fuel proportioning needle 4 which has a profiling. The proportioning needle interacts with a fuel nozzle 5 which opens by means of a not further identified immersion tube in a float chamber 6. The nozzle 5 opens into a carrier air channel 7 which opens at one end into a Venturi 8 which is arranged upstream of a throttle valve 9 in the main air channel 1 and has at the other end for increase of the flow velocity a a duct portion 10 which is connected with the inlet of a wet running, electrically operated vane pump 11. Fuel is admitted to the flow chamber 6 by means of a pump 12 in whose line a pressure relief valve 13 is arranged which feeds the excessive fuel to the electric motor of the vane pump and from there the fuel is returned to the tank by means of a line 14. In this way it is simultaneously possible to remove leakages from the vane pump 11. The level of fuel in the float chamber is controlled in a conventional manner by means of a not further identified float arrangement. The float chamber is connected with an acceleration pump 15 which is operated in dependence on the position of the throttle valve 9 and feeds the supplementary acceleration amount via a line 16 upstream of the Venturi 8 to the main air channel 1. A bypass line 17 which can be controlled in the cross-section is associated with the throttle valve 9, whereby in dependence on the operating parameters a control or regulation can take place whereby for instance the increased air throughput of the internal combustion engine can be covered during the warm running phase. For this purpose, a piston or slide 18 can be changed in its position by means of an electrically heated bimetal in dependence on the input data of a controller 19. Downstream from the vane pump, a switching valve 20 is arranged in the line 22 which leads to the inlet lines 21 and the position of this valve enables alternately the course of the carrier air, enriched with fuel, to the associated suction pipe sections or, in the case of for instance thrust operation, opens a return line 23 to the tank.

A calibrated channel 24 which originates from the float chamber opens into the carrier air channel 7 in the proximity of the proportioning area 4/5, and the free cross-section of this channel is controlled by a solenoid valve 25 which can also be controlled by means of the controller 19 which processes the operating parameters. With this additional proportioning device, it is possible to control the supplementary fuel amount for starting. This has the advantage that thereby an increase of the differential pressure is not necessary to that extent that it would lead to a very strong decrease in the air volume of the carrier air stream. This would result into a less satisfactory treatment of the emulsion at the place of injection. With the additional proportioning device, also a device is created for all other cases of mixture enrichment or control which is simple to control or can be operated by means of the controller 19, for instance, by pulse width modulation.

Upstream from the fuel inlet areas into the carrier air channel 7 a fuel back stop 26 is provided in the carrier air channel with which it is prevented that, due to the pulsations which exist in the carrier air channel 7 to a small extent, the proportioned fuel can flow to the main air channel 1. At the same time, this backstop 26 is to be created in such a way that a flow of fuel in direction of the Venturi is possible in case of an emergency of the system during failure of the vane pump 11 as will be further described below.

In the carrier air channel 7 a differential pressure valve 27 is arranged which is constructed as a flat seat valve which is acted upon on one side by the negative pressure of the Venturi and on the other side by a controllable differential force and the pressure at the diaphragm 28 which then results at the proportioning area 4/5. The diaphragm controls the flow opening 29 of the carrier air channel, with the exception of the channel 30 which serves as emergency channel for removal of the fuel amounts and which decreases in direction of the Venturi. In case of an emergency, the flow direction in the channel 7 reverses and fuel reaches the cylinders via the main air channel 1. Then the fuel supply system works like a carburetor, that is in the lower load range like a constant pressure carburetor with variable fuel proportioning cross-section and in the upper load range like a so-called fixed choke carburetor. For explanation of this operating range, it shall also be pointed out that the mentioned flow opening is also opened in this operating range always to a certain extent by the force of a spring 31. During normal operation, the action of force of this spring is varied for setting the signal level of the differential pressure in the carrier air channel downstream from the differential pressure valve 27. For this purpose, a magnet arrangement 32 may be provided which is excited in dependence on the operating parameters by means of the controller 19. In addition, at this area engagement of a level corrector is possible and the action of force at the differential pressure valve can be varied by means of a bimetal element 33 which is acted upon by means of a heating element 34 in dependence on the fuel and/or air temperature. Therefore, for instance the ambient temperature of the air can be compensated for and also the viscosity changes of fuel during increases in temperature can be eliminated. As is known, the flow values of fuel in a needle-nozzle combination change very strongly in dependence on the viscosity. This arrangement for compensation of the viscosity has the advantage, compared to the known arrangement which would operate with a displacement device for the nozzle or the needle, i.e. would change the proportioning surfaces, that with this arrangement automatically different basic idling adjustments can be compensated for. This is not possible in a temperature dependent relative motion of the two proportioning elements in dependence upon the temperature, because the variable Reynold number enters very strongly in the flow values.

The controller 19 may also be constructed as a computer in which engine performance graphs are stored and consequently the values for specific operating points can be recalled.

We claim:

1. A fuel supply system for mixture-compressing internal combustion engines, with a carrier air channel which is arranged in addition to a main air channel, having a throttle valve, and branches off from said main air channel between an air quantity measuring valve and the throttle valve, the fuel metering nozzle discharging into said carrier air channel, with a proportioning valve, provided at said fuel metering nozzle, said proportioning valve being adjustable in dependence on an air quantity measuring valve which is arranged in said main air channel upstream from said throttle valve, with a pump assigned to said fuel metering nozzle, with distributor channels which originate from said carrier air channel upstream from said pump, said distributor channels leading to the associated suction nozzles before the inlet valve, with a differential pressure valve which controls the carrier air stream, is arranged before said fuel metering nozzle and is adjustable in dependence on operating parameters, the effective surface of said differential pressure valve being acted upon on the one side by a variable force and the air pressure in said carrier air channel at the fuel outlet area and on the other side by the air pressure in said carrier air channel before the flow opening of said differential pressure valve, characterized in that said carrier air channel (7) discharges into a Venturi (8) which is arranged upstream from said throttle valve (9) in said main air channel (1).

2. A fuel supply system according to claim 1, characterized in that said pump (11) is constructed as a wet running, electrically operated vane pump.

3. A fuel supply system according to claim 1, characterized in that the variable force at said differential pressure valve (27) is exercised by a bimetal strip (33).

4. A fuel supply system according to claim 3, characterized in that said bimetal strip is exposed to the temperature of the fuel.

5. A fuel supply system according to claim 3, characterized in that said bimetal strip is heated by means of a heating element (34) in dependence on the fuel temperature and/or the air temperature.

6. A fuel supply system according to claim 1, characterized in that a bypass (30) is arranged to said flow opening (29) of said carrier air channel (7).

7. A fuel supply system according to claim 1, characterized in that a calibrated channel (24) which is controllable in its free cross-section by an electrically controlled valve (25) and which originates from the flow chamber (6) opens into said carrier air channel (7).

8. A fuel supply system according to claim 1, characterized in that said carrier air channel (7) has a back stop (26) upstream from said fuel metering nozzle (5).

9. A fuel supply system according to claim 1, characterized in that a switching valve (20) is arranged upstream of said pump (11) in said distributor channel (22), said switching valve switches alternately between the way to said suction nozzles or to the tank return (14).

10. A fuel supply system according to claim 1, characterized in that a channel (17) is provided which bypasses said throttle valve (9) and whose free cross-section is controlled by means of a slide (18) in dependence on operating parameters.

11. A fuel metering system according to claim 1, characterized in that said throttle valve (9) is elastically coupled mechanically with an acceleration pump (15) which is fed with fuel from said float chamber and opens upstream from said Venturi (8) into said main air channel (1).

* * * * *